US008424354B2

(12) United States Patent
Pavlicevic et al.

(10) Patent No.: US 8,424,354 B2
(45) Date of Patent: Apr. 23, 2013

(54) ROLLING PLANT

(75) Inventors: Milorad Pavlicevic, Udine (IT); Alfredo Poloni, Fogliano Redipuglia (IT); Simone Barcherini, Terni (IT); Gianluca Bazzaro, Codroipo (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 1176 days.

(21) Appl. No.: 12/226,021

(22) PCT Filed: Apr. 2, 2007

(86) PCT No.: PCT/EP2007/053156

§ 371 (c)(1),
(2), (4) Date: Oct. 3, 2008

(87) PCT Pub. No.: WO2007/113277

PCT Pub. Date: Oct. 11, 2007

(65) Prior Publication Data

US 2009/0165517 A1 Jul. 2, 2009

(30) Foreign Application Priority Data

Apr. 5, 2006 (IT) ..... MI2006A0666

(51) Int. Cl.

| | |
|---|---|
| ***B21B 13/14*** | (2006.01) |
| ***B21B 13/00*** | (2006.01) |
| ***B21B 37/58*** | (2006.01) |

(52) U.S. Cl.

USPC ..... 72/241.2; 72/10.3; 72/224

(58) Field of Classification Search ..... 72/221, 72/224, 225, 226, 232, 234, 241.1, 243.6, 72/249, 252.5, 241.2, 10.3

See application file for complete search history.

(56) References Cited

U.S. PATENT DOCUMENTS

| | | | | |
|---|---|---|---|---|
| 1,700,054 | A * | 1/1929 | Iversen | 72/241.2 |
| 1,792,458 | A * | 2/1931 | Barten | 72/29.1 |
| 3,861,188 | A * | 1/1975 | Kamit et al. | 72/234 |
| 4,512,169 | A * | 4/1985 | Miura | 72/9.2 |
| 6,527,882 | B1 * | 3/2003 | Wehage et al. | 148/541 |

FOREIGN PATENT DOCUMENTS

| | | |
|---|---|---|
| JP | 54133455 | 10/1979 |
| JP | 60141306 A * | 7/1985 |
| JP | 62137102 | 6/1987 |
| WO | WO 03018221 | 3/2003 |
| WO | WO 03018223 | 3/2003 |

* cited by examiner

*Primary Examiner* — Teresa M Ekiert
(74) *Attorney, Agent, or Firm* — Stetina Brunda Garred & Brucker

(57) ABSTRACT

A hot-rolling plant (50) for the production of metal strips comprising a roughing stand (2), a reheating furnace (3) or a maintenance tunnel for maintaining the temperature of the product, a pre-finishing mill train (4), comprising three or four stands, a finishing mill train (5), comprising two or three stands, for finishing the product, in which the work rolls of one stand are provided with their own motor drive, independent one from each other, so as to allow the peripheral speeds of both of said work rolls to be autonomously varied under rolling load.

20 Claims, 9 Drawing Sheets

ROLLING PLANT

FIELD OF THE INVENTION

The present invention relates to a rolling plant, in particular for hot-rolling of metal products, such as strips in high strength steel and/or plain carbon steel.

STATE OF THE ART

Various types of hot-rolling plants for the production of metal products, such as strips, are known.

The rolling line in these plants is provided with:

- a roughing stand for roughing the cast product, such as a slab, coming from the casting machine;
- a reheating furnace or a tunnel for maintaining the temperature of the product;
- a pre-finishing mill train, comprising for example three or four stands, for pre-finishing the product;
- a finishing mill train, comprising for example two or three stands, for finishing the product.

Generally, the pre-finishing and finishing mill trains in such plants are provided respectively with standard rolling stands.

In the case in which the steel to be rolled is a plain carbon type, i.e. a steel which contains carbon and manganese without others alloying elements, some plants in the prior art provide the use of asymmetrical finishing stands, that is finishing stands having work rolls different in diameter, with the aim of improving the final microstructure of the strip. In particular, said stands provide the top work cylinder or roll having a smaller diameter than the bottom work roll; moreover, the only motor-driven roll is the bottom roll having the biggest diameter, while the other one idles and is pulled by the moving strip.

An example of such a hot-rolling plant is described in document JP60141306. One drawback of the hot-rolling plants in the prior art is that they produce strips with relatively poor mechanical properties. To obtain a better quality steel strip, the same strip must be subjected to a cold-rolling process, involving additional times and costs of production.

Instead, in the case in which the steel to be rolled is a microalloy steel, for example high strength steels, such as "DP" (Dual Phase) steels and "TRIP" (TRansformation induced Plasticity) steels used in particular in the automotive industry, prior art plants provide the use of symmetrical rolling stands that must act with very high rolling forces, at the limit of their possibility, so as to perform the necessary thickness reductions. These known plants, however, does not allow to obtain all the strip widths required on the market. Therefore, the production of said types of steel by means of the actual plants, in addition to be difficult due to high stresses to be applied to the steel, involves high energy and maintenance costs.

Therefore there is a need to produce a rolling plant which is capable of overcoming the aforesaid drawbacks.

SUMMARY OF THE INVENTION

The main object of the present invention is to produce a hot-rolling plant for the production of steel strips in which at least one stand of the finishing mill train is capable of controlling and varying, when under load, the peripheral speeds of each of the work rolls independently.

In this way different flow patterns can be imposed on the top microstructure with respect to the bottom microstructure of the strip, making it possible to obtain:

- in the case of plain carbon steels, a rolled strip with a very fine metallurgical structure and mechanical properties comparable to those obtainable with cold-rolling. In such a way the hot-rolled product already has the characteristics of a finished product and is directly usable without requiring further processing;
- in the case of high strength steels, energy costs lower than those of the traditional plants; this also involves that higher strip widths can be obtained with the same rolling force and power, for example widths higher than 1.300 mm as required by numerous automotive applications.

An other object of the invention is to accumulate internal deformation of the strip, possiblest at the end of the finishing rolling train determining higher reductions in the last stands at a lower temperature.

According to a first aspect of the invention the aforesaid objects are achieved by producing at least one rolling stand, of the four-high or six-high type that is suitable to finish a metal product, in particular steel strips, comprising bottom and top work rolls, the top work roll having a smaller diameter than the bottom work roll, each of said work rolls being suitable to be made to rotate independently one from each other by motor means, so as to allow the peripheral speeds of said both work rolls to be autonomously varied under rolling load.

A second aspect of the invention provides for producing a hot-rolling plant for the production of metal products, in particular steel strips, defining a direction of rolling, that comprises, arranged in the direction of rolling,

- a pre-finishing unit, suitable to pre-finish the metal product, comprising a plurality of pre-finishing rolling stands,
- a finishing unit, suitable to finish the metal product, comprising at least two finishing rolling stands, in which the respective top work rolls have a smaller diameter than the bottom work rolls, wherein at least one finishing rolling stand is provided with bottom work roll and top work roll suitable to be made to rotate independently one from each other by motor means, so as to allow the peripheral speeds of each of the work rolls to be autonomously varied under rolling load.

In the case of plain carbon steels, the internal structure of the strip obtained with the rolling plant of the invention gives the steel good mechanical properties, and in particular:

- a yield strength of over 600 MPa, about twice that of steel processed by means of conventional hot-rolling processes;
- a maximum mechanical resistance of over 850 MPa;
- an elongation of at least 30%, around half that of steel processed using conventional processes;
- improved toughness;
- improved fatigue resistance;
- improved corrosion resistance;
- improved recyclability, thanks to the low alloy content.

By adjusting, when under load, the respective speeds of the work rolls independently it is possible to achieve different shear flow patterns on the top and bottom part of the strip. Acting on the speed differential between the work rolls allows advantageously to obtain the following advantages:

- possibility of making materials, which are not originally of particularly high quality, more "noble" in terms of their resistance features;
- possibility of increasing deformation efficiency by controlling the grain size through the shear flow pattern imposed;
- possibility of obtaining the desired final grain size as a function of the type of input steel;
- possibility of obtaining a more or less fine grain size with the same intensity of cooling on leaving the stand;

possibility of compensating for a possible lack of adequate cooling;

possibility of recuperating wear on the work rolls, i.e. by compensating for the reduction in diameter by increasing the speed of the roll;

possibility of "absorbing" any geometric irregularities on the incoming product;

possibility of efficiently controlling head and tail ends of the strip which usually have different temperatures, thus reducing the rejects of product;

possibility of controlling defects regarding strip planarity;

possibility of obtaining a very flexible plant in the light of the aforesaid advantages.

Advantageously, in at least one rolling stand of the finishing mill train, the use of work rolls having also different diameters allows to have an additional degree of freedom and to amplify the effect obtained by means of their different peripheral speed.

The dependent claims describe preferred embodiments of the invention.

BRIEF DESCRIPTION OF THE FIGURES

Further characteristics and advantages of the invention will be more apparent in the light of the detailed description of preferred, although non-exclusive, embodiments of a rolling plant illustrated, by way of a non-limiting example, with the aid of the accompanying drawings wherein.

DETAILED DESCRIPTION OF PREFERRED EMBODIMENTS OF THE INVENTION

Figure 1:
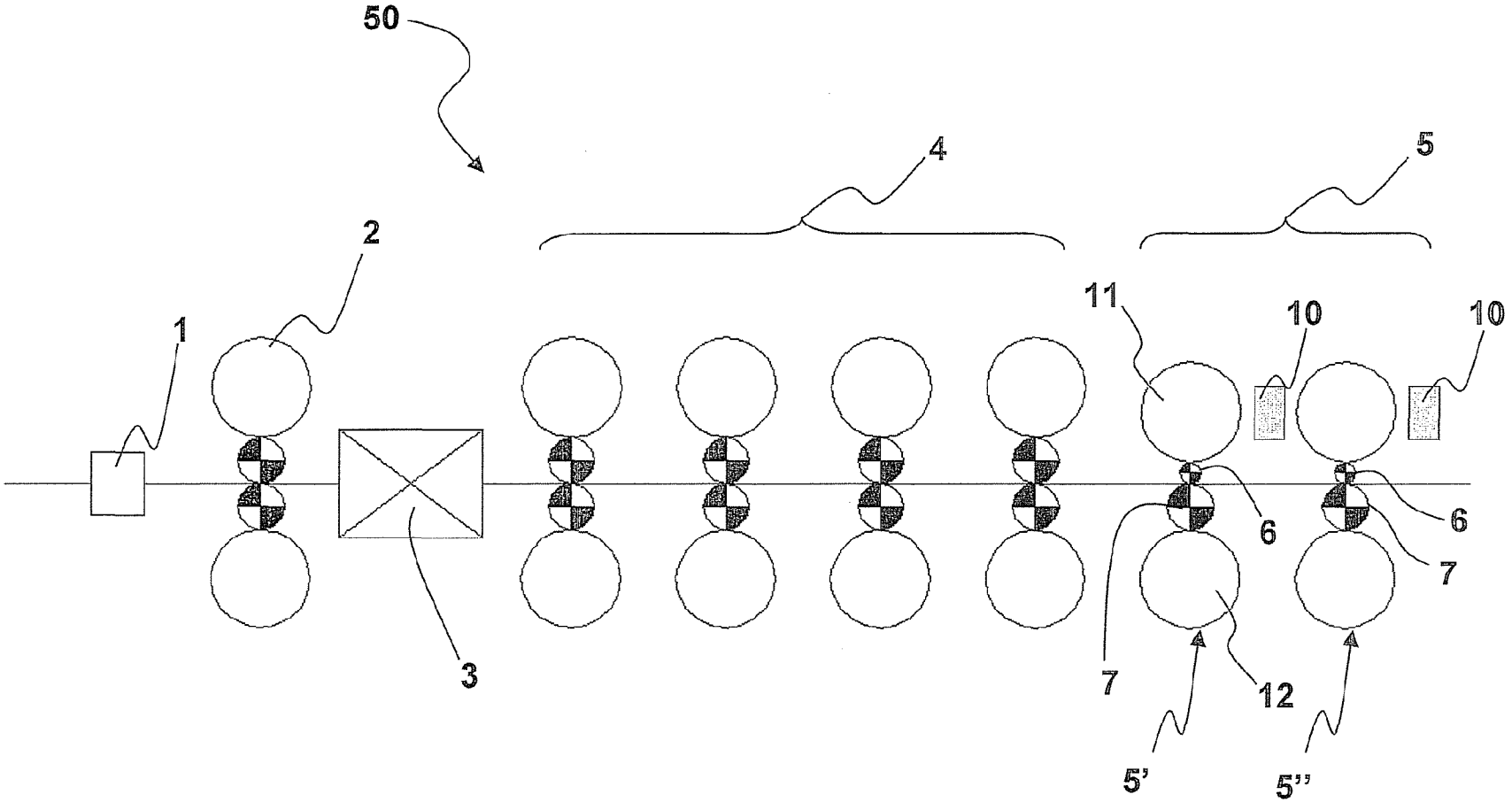
FIG. 1 is a schematic illustration of a side view of a first embodiment of the plant of the invention.

With reference to FIG. 1, a rolling plant is represented, indicated as a whole with the reference 50, comprising:

a vertical edger 1, suitable to position the cast product, for example a slab, in the rolling axis prior to entering the mill train;

a roughing stand 2 of a known type;

a slow-cooling insulated reheating furnace or maintenance tunnel 3 for maintaining the temperature;

a pre-finishing mill train 4 comprising a predetermined number of traditional stands, having a single motor to operate both work rolls at the same peripheral speed by means of a gear box and two spindles;

a finishing mill train 5 comprising a predetermined number of stands, generally from two to three, preferably two.

Alternatively, all the stands downstream of the reheating furnace or maintenance tunnel 3 can be finishing stands. The stands may be, for example, of the four-high or six-high type.

At the exit of each stand of the finishing mill train 5 there is provided, as is known in the prior art, a cooling device 10 for cooling the rolled product.

In a first preferred embodiment, illustrated in FIG. 1, the pre-finishing mill train 4 comprises four stands; the number of said stands can preferably vary from two to four. The finishing mill train 5, instead, comprises at least two stands. These stands 5', 5" have preferably top work rolls 6 the diameter of which is smaller than that of the bottom work rolls 7 and, advantageously, both pairs of work rolls 6, 7 are motor driven, as also illustrated in the diagram in FIG. 2*a*.

In all the figures, the work rolls indicated with two black sectors are motor driven. According to an embodiment, each of the work rolls is provided with a respective motor drive, independent from that of the other one. The motors that drive the work rolls are preferably of the alternating current type and each is equipped with an inverter to control the number of revolutions.

Advantageously one of the motors of the work rolls is provided with a braking device (not illustrated), for example an eddy current braking device, so that the rolls can be slowed down in order to guarantee high deceleration values, when requested by the process.

Figures 2A, 2B, 2C, 2D:
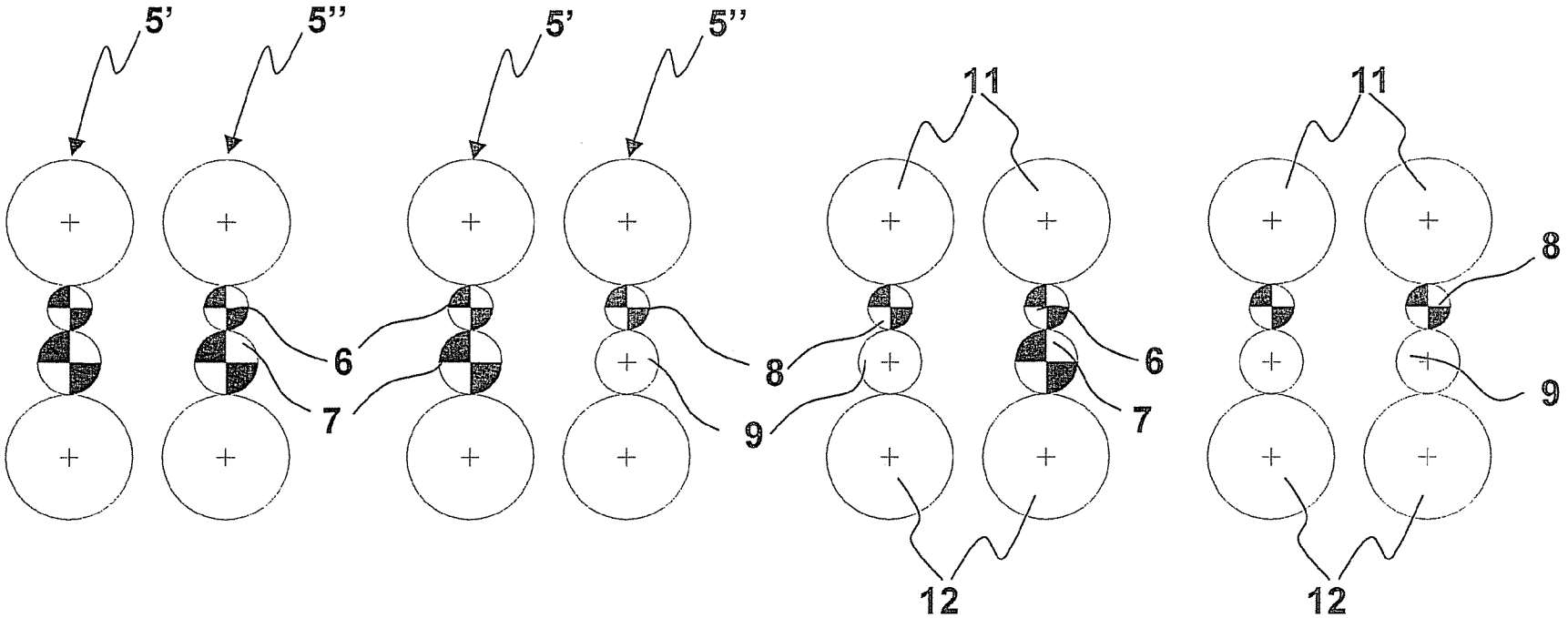
FIG. 2*a* is a schematic side view of part of the plant in FIG. 1.
FIGS. 2*b* and 2*c* are schematic side views of alternative forms of a second embodiment of part of the plant according to the invention.
FIG. 2*d* is a schematic side view of a further alternative embodiment of part of the plant.

In a second embodiment, illustrated in FIG. 2*c*, in the first stand 5' of the finishing mill train the bottom work roll 9, with the bigger diameter, idles while only the top work roll 8, with the smaller diameter, is motor-driven. The work rolls 6, 7 in the last stand are driven by means of two independent motors.

With this configuration the following advantages are achieved:

in the first stand only one motor and one shaft are used with savings in terms of initial investment and running costs, in that less maintenance is required;

there is a further reduction in torque and force.

In this case, in the first stand only the angular velocity of the motor-driven work roll 8 can be controlled, as the other work roll 9 is pulled due to friction by the rolled product.

According to one alternative embodiment, illustrated in FIG. 2*b*, the stand having only the smaller top work roll 8 motor-driven is placed downstream of the stand in which both work rolls 6, 7 are independently motor-driven.

In accordance with another alternative embodiment, illustrated in FIG. 2*d*, only the smaller top work roll 8 in all the stands of the finishing mill train is motor-driven.

In the first and second embodiments of the invention the supporting rolls 11, 12, provided in each finishing stand, have the same diameter.

Figure 3:
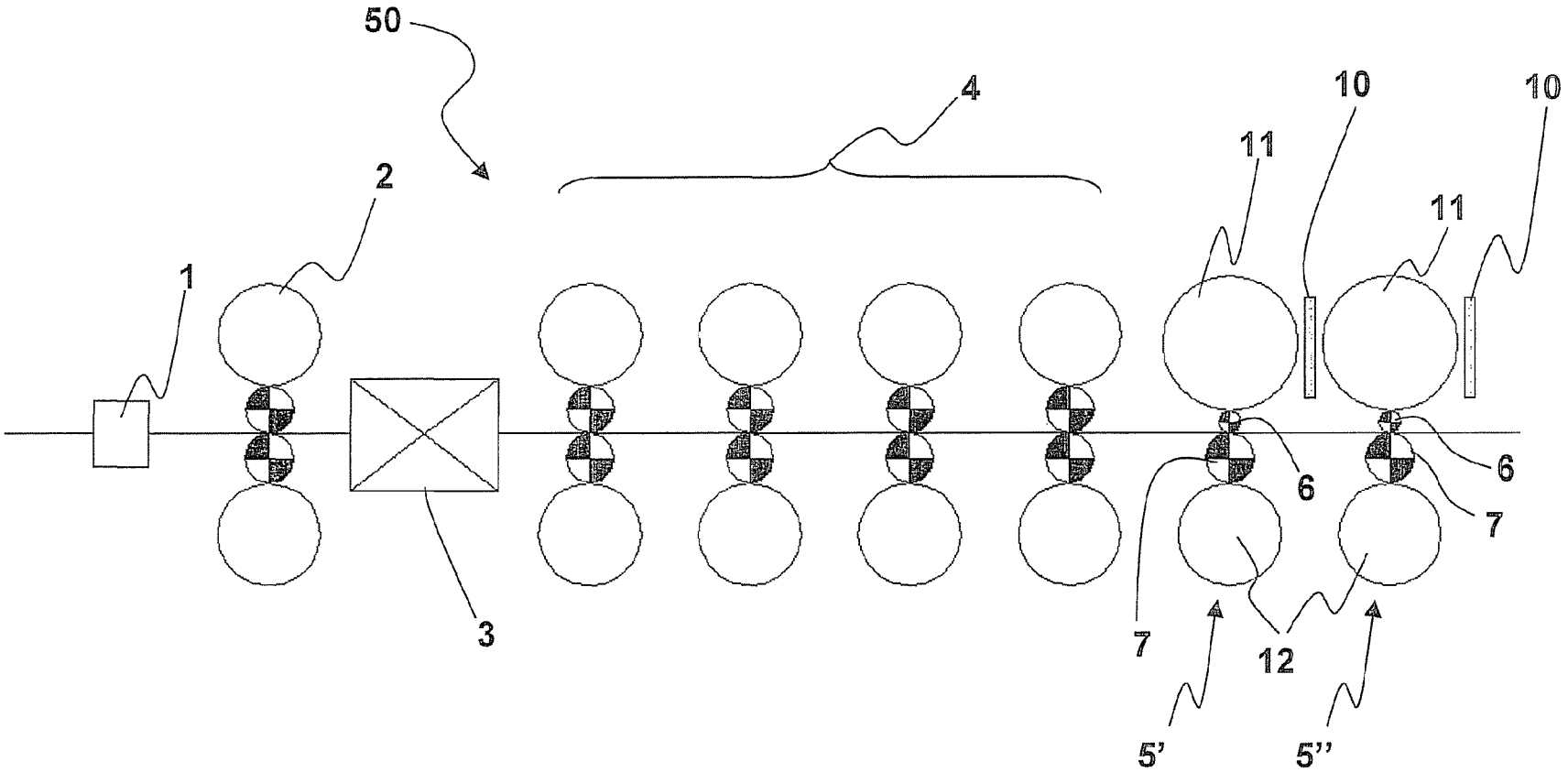
FIG. 3 is a schematic side view of a third embodiment of the plant according to the invention.
Figures 4A, 4B, 4C, 4D:
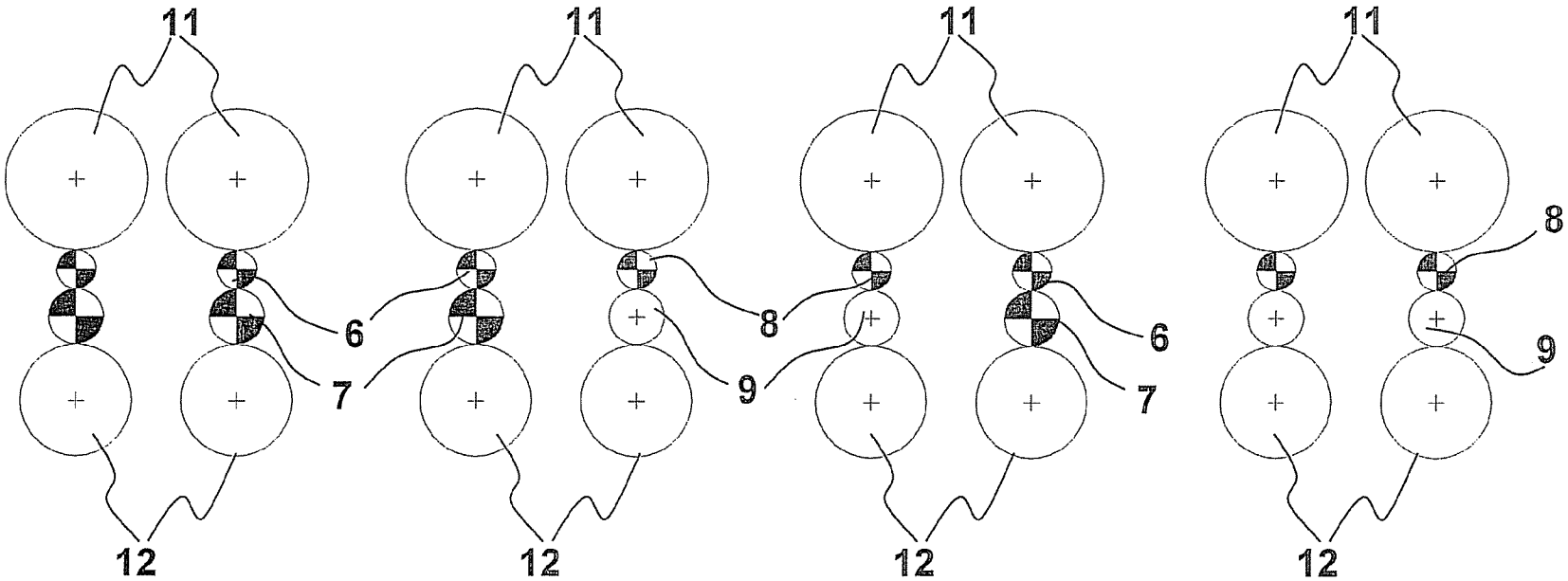
FIGS. 4*a* to 4*d* show alternative embodiments of the plant in FIG. 3.
Figure 5:
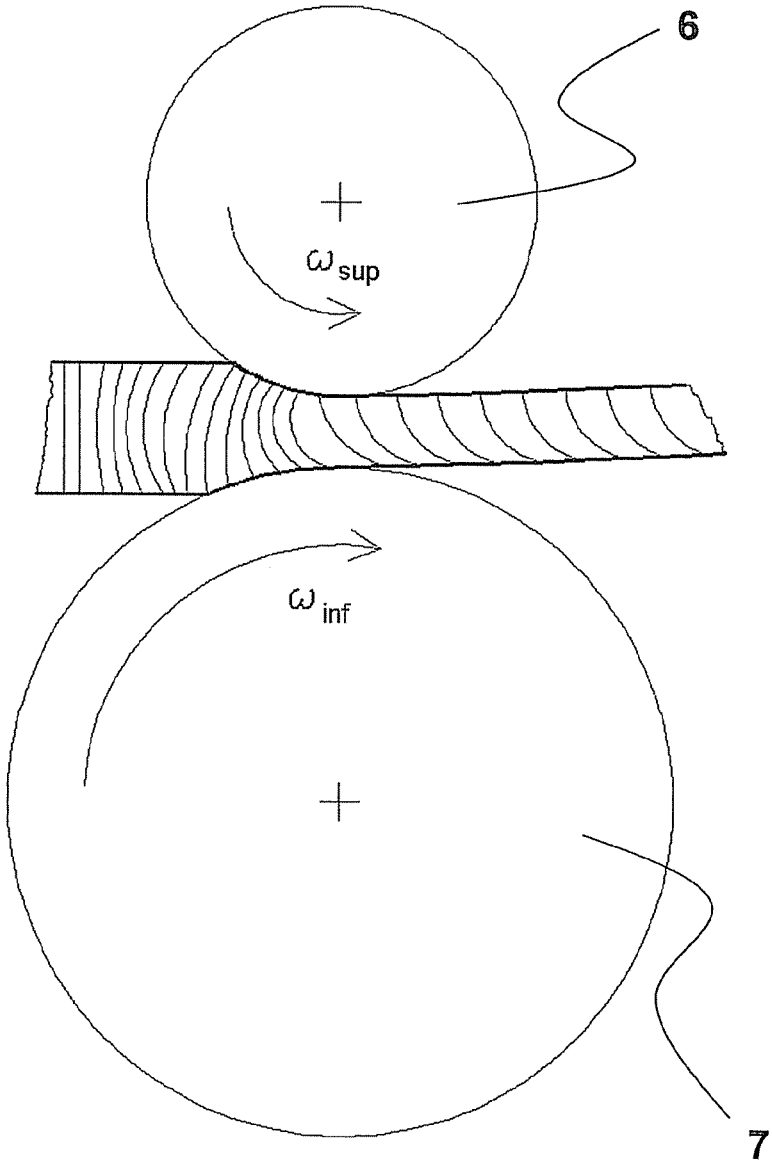
FIG. 5 is a schematic illustration of components of a rolling stand of the plant according to the invention.

A third advantageous embodiment of the invention, illustrated in FIG. 3, provides the use in the finishing stands 5', 5" of supporting rolls 11, 12, also known as BURs or back-up rolls, each having a different diameter.

The back-up rolls with different diameters can be provided for one or for both of the finishing stands.

This solution with back-up rolls having different diameters, regardless of whether the work rolls are provided with a single or double motor drive, according to the embodiments illustrated in Figures from 4*a* to 4*d* corresponding to those illustrated in Figures from 2*a* to 2*d,* makes it possible to improve the overall rigidity of the rolling stands with asymmetrical work rolls, i.e. work rolls having different diameters.

Figure 7:
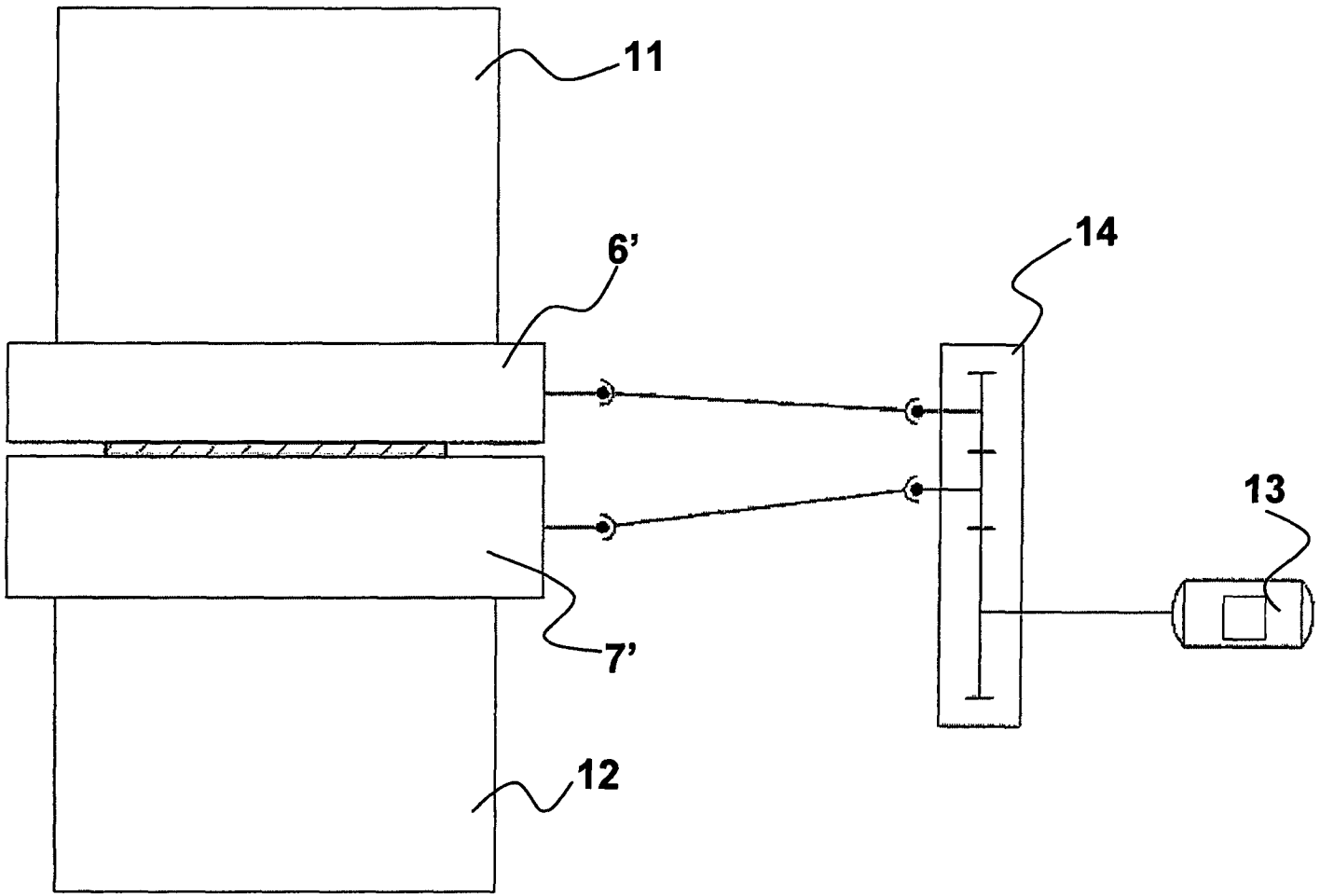
FIG. 7 show a transverse view of an embodiment of a rolling stand.

In accordance with another alternative embodiment, all the layouts illustrated in Figures from 2*a* to 2*d* and from 4*a* to 4*d* can be obtained providing, for each of the two finishing stands, only one motor 13 transmitting the motion to the two work rolls 6', 7' by means of a variable speed splitting-reduction gear 14, as schematically illustrated in FIG. 7.

Advantageously said splitting-reduction gear allows:

- to change the speed ratio of the work rolls, as there is provided only one motor;
- to disconnect, that is to make idle, any of the two work rolls in any instant;
- control the relative speeds without need of brakes and/or other mechanisms based on dissipation phenomena, with saving in terms of energy;
- control the power in a appropriate way choosing the right gear ratio, so optimizing energy consumption.

With this embodiment the achievable mechanical properties of steel strip are lower than the previous embodiment, but in front of lower investment and running costs and also of lower management skills required.

Figure 8A:
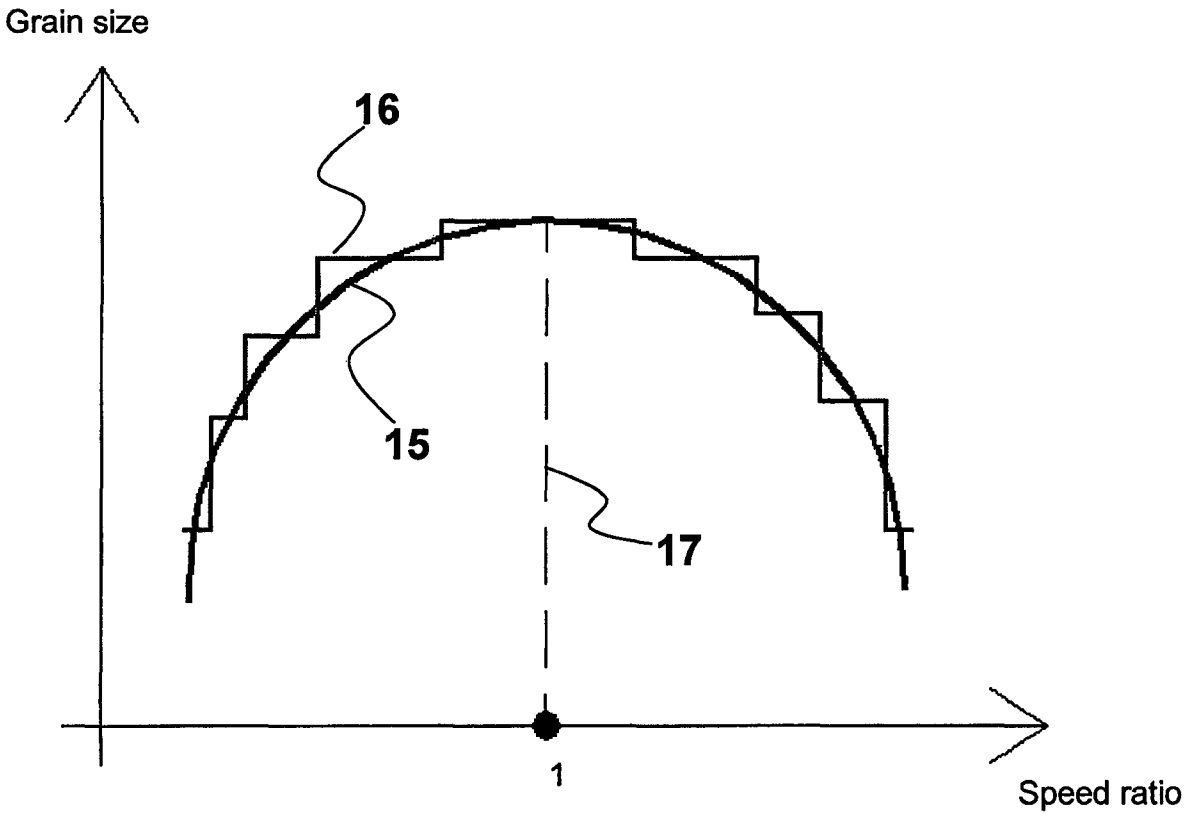
FIG. 8*a* show qualitative trends of the average size of the crystalline grains for a plain carbon steel in function of the ratio between the peripheral speeds of top and bottom work rolls.

In the qualitative graph of FIG. 8*a* there is illustrated the trend of the average size of the crystalline grains for a plain carbon steel in function of the ratio between the peripheral speeds of top and bottom work rolls.

As it can be noted, the grain size is reduced with increasing or decreasing of the speed ratio with respect to the value equal to 1.

The continuous curve 15 of parabolic shape, having the vertex corresponding to the ratio value equal to 1, refers to the embodiment of the invention providing two independent motors for each work roll.

The step curve 16 instead refers to the embodiment of the invention providing an only motor provided with splitting-reduction gear; in this case the change of speed ratio under load is not continuous but discrete because it depends on the gear ratio of the reduction gear.

The graph, moreover, show a curve 17 that refers to a conventional rolling in which the work roll speed ratio is fixed.

Figure 8B:
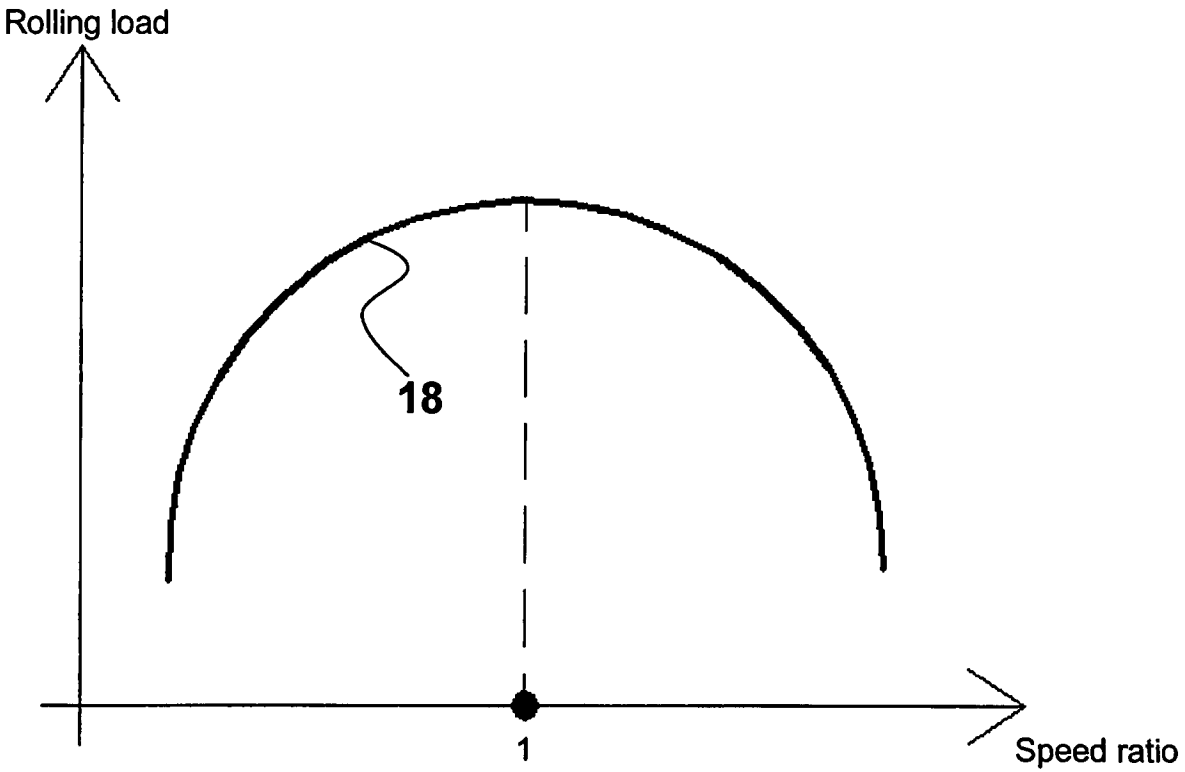
FIG. 8*b* show the qualitative trend of the rolling force, necessary to roll high strength steels, in function of the of the ratio between the peripheral speeds of top and bottom work rolls.

In the qualitative graph of FIG. 8*b* there is illustrated the trend of the rolling force, necessary to roll high strength steels, in function of the of the ratio between the peripheral speeds of top and bottom work rolls. As it can be noted, the trend 18 is practically equal to that illustrated in FIG. 8*a*.

According to the invention, the best results in terms of microstructure refinement or reduction of the rolling stresses are advantageously obtained by using, for the finishing stands, values of the speed ratio equal to or higher than 1,05, or equal to or lower than 0,95.

Figure 6B:
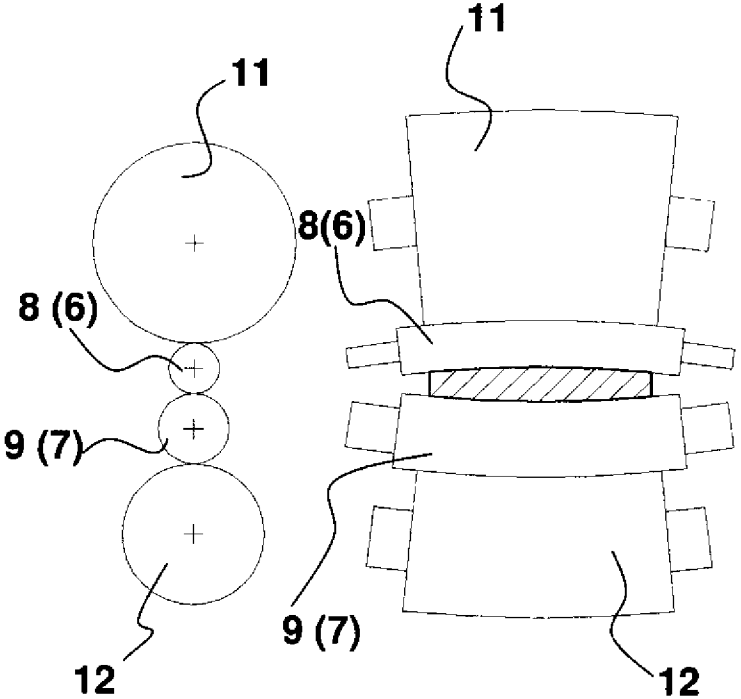
FIGS. 6*a* and 6*b* show a transverse view of the rolls during operation respectively in the case of a stand of a known type and in the case of a stand according to the invention.
Figure 6A:
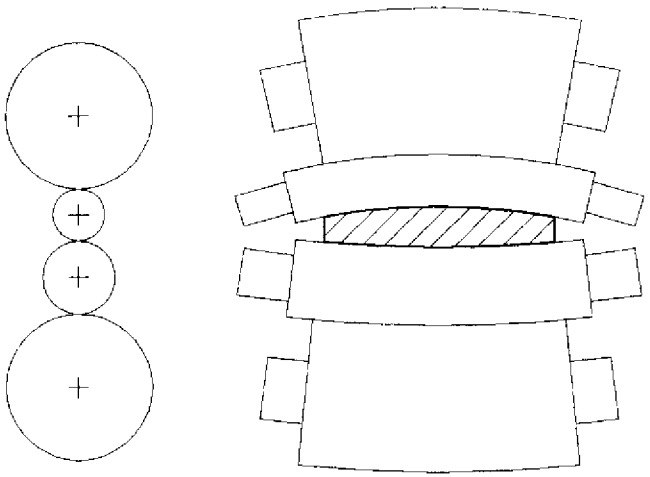
Fig. 6a PRIOR ART

In the case represented in FIG. 6*a* (prior art solution) the flexural rigidity in the upper part of the stand differs from that in the lower part; this phenomenon creates different levels of elasticity and thus different deformations in the fibers of the strip and a final geometric form of the strip that does not conform to the specifications for the finished product.

To overcome this undesirable effect, in the third embodiment the diameter of one of the two back-up rolls is increased to recuperate rigidity. In particular, the top back-up roll 11, adjacent to the work roll 8, 6 with the smaller diameter, has a bigger diameter than the bottom back-up roll 12, adjacent to the work roll 9, 7 with the bigger diameter. This allows to obtain equal deformations in the fibers of the strip and a final geometric form of the strip according to the specifications for the finished product.

In experiments it has been found that excellent results can be achieved in terms of flexural rigidity if the diameters of the back-up and work rolls of a single stand satisfy the following formula:

$$d_{BUR,t}^4+d_{WR,t}^4=d_{BUR,b}^4+d_{WR,b}^4,$$

where $d_{BUR,t}$=diameter of the top back-up roll (BUR) 11;

$d_{WR,t}$=diameter of the top work roll (WR) 8,6;

$d_{BUR,b}$=diameter of the bottom back-up roll (BUR) 12;

$d_{WR,b}$=diameter of the bottom work roll (WR) 9,7.

For example, as illustrated in the case shown in FIG. 6*b,* being known p0 $d_{WR,t}$=560 mm p0 $d_{WR,b}$=680 mm p0 $d_{BUR,b}$=1450 mm then we determine that: p0 $d_{BUR,t}$=1459 mm.

All the embodiments of the invention described above can advantageously provide a crossing mechanism for the back-up roll, i.e. a mechanism for controlling the inclination of the roll with respect to the rolling surface, in order to obtain improved control of the planarity of the strip.

Moreover, the work rolls in the stands can have a continuously variable crown (CVC) profile.

A further aspect of the invention regards the strip cooling system, provided at the exit from the rolling stands of the finishing mill train 5 in the case of plain carbon steel rolling. The cooling requested by the process must guarantee a high rate of heat removal and the solutions in the prior art involve the use of very large flows of water using complex and costly devices. The plant, object of the present invention, on the other hand, provides the use of other liquids instead of water, for example organic polymeric liquids. These substances have a higher specific heat than water, which means that a smaller flow is required to remove the same amount of energy. Smaller flows, requested for cooling, advantageously involves the use of less power for pumping and thus more compact and less expensive cooling devices, reducing production and running costs.

An intense cooling at the exit of each stand allows the nucleation of new grains to be delayed, maintaining a "low" temperature, namely of around the Ar3 temperature, that is the temperature of transition from phase $\alpha$ to phase $\gamma$ in the Iron-Carbon phase diagram. The cooling thus makes it possible to maintain unaltered the size of the grains obtained on leaving the rolling stand.

Advantageously the ultra-fine internal structure of the rolled plain carbon steel obtained using the plant according to the invention allows said steel to be used in place of and/or with "DP" (Dual Phase) steels such as ferritic-martensitic steels, and "TRIP" (TRansformation Induced Plasticity) steels. Therefore, starting from a "poor" and low cost material such as plain carbon steel, it is possible to obtain a final product substantially equivalent to a high strength steel, from the point of view of mechanical properties and corrosion resistance, with a considerably lower production cost.

The specific methods of production described herein do not limit the content of this application, which covers all the embodiments of the invention defined by the claims.

The invention claimed is:

1. A rolling stand suitable to finish a metal product, the rolling stand comprising:

bottom and top work rolls the top work roll having a smaller diameter than the bottom work roll, the bottom and top work rolls being rotatable at different peripheral speeds while under is rolling load;

a motor system for transmitting rotation to each of the bottom and top work rolls to allow for different peripheral speeds of the bottom and top work rolls while under the rolling load;

top and bottom back-up rolls, the top back-up roll having a bigger diameter than the bottom back up roll, the top back-up roll being adjacent to the top work roll and the bottom back-up roll being adjacent to the bottom work roll;

wherein the diameters of the respective back-up rolls and work rolls satisfy the following, formula:

$$d_{BUR,t}^4+d_{WR,t}^4=d_{BUR,b}^4+d_{WR,b}^4,$$

where $d_{BUR,t}$=diameter of the top back-up roll, $d_{WR,t}$=diameter of the top work roll, $d_{BUR,b}$=diameter of the bottom back-up roll, $d_{WR,b}$=diameter of the bottom work roll.

2. Rolling stand according to claim 1, wherein said motor system comprises two motors independent one from each other, each motor suitable to transmit the motion to the respective work roll.

3. Rolling stand according to claim 1, wherein said motor system comprises a motor suitable to transmit the motion to the work rolls by means of a variable speed splitting-reduction gear.

4. Rolling stand according to claim 1, wherein the ratio between the peripheral speeds of top and bottom work rolls is equal to, or higher than, 1.05.

5. Rolling stand according to claim 1, wherein the ratio between the peripheral speeds of top and bottom work rolls is greater than 0 and less than or equal to 0.95.

6. Rolling stand according to claim 1, wherein the work rolls have a continuously variable crown profile.

7. Rolling stand according to claim 1, wherein the back-up rolls are provided with a crossing mechanism.

8. A hot rolling plant for the production of metal products, the plant as arranged in a direction of rolling comprising:

a pre-finishing unit, suitable to pre-finish the metal product, comprising a plurality of pre-finishing rolling stands, a finishing unit, suitable to finish the metal product, comprising at least two finishing rolling stands, wherein at least one finishing rolling stand comprises:

a first work roll and a second work roll rotatable from each other so as to allow for different peripheral speeds of each of first and second work rolls while under a rolling load, a motor system for transmitting rotation to each of the first and second work rolls to allow for different peripheral speeds of the first and second work rolls while under the rolling load;

wherein the respective second work rolls have a smaller diameter than the first work rolls, wherein the finishing rolling stands comprise back-up rolls having different diameters, wherein the second back-up roll is adjacent to the second work roll and has a bigger diameter than the first back-up roll, adjacent to the first work roll.

9. Plant according to claim 8, wherein all the rolling stands of the finishing unit have work rolls each provided with an independent motor means.

10. Plant according to claim 8, wherein all the rolling stands of the finishing unit are provided with a motor suitable to transmit the motion to the work rolls by means of a variable speed splitting-reduction gear.

11. Plant according to claim 8, wherein at least one rolling stand of the finishing unit has an idle bottom work roll and a top work roll suitable to be made to rotate by a relative motor means.

12. Plant according to claim 8, wherein the pre-finishing unit comprises between two and four stands.

13. Plant according to claim 8, wherein the motor system for driving the work rolls are alternating current motors each equipped with an inverter to control the number of revolutions.

14. Plant according to claim 8, wherein motor system is motors associated with the work rolls, and one of the motors of the work rolls is equipped with an eddy current braking device.

15. Plant according to claim 8, wherein the work roll of the stands have a continuously variable crown roll profile.

16. Plant according to claim 8, comprising cooling devices for cooling the metal product suitable to use organic polymeric cooling fluids.

17. Plant according to claim 8, comprising a crossing mechanism of the back-up rolls.

18. Plant according to claim 8, wherein at least two of the rolling stands of the finishing unit have respective bottom work rolls and top work rolls suitable to be made to rotate by motor means independently on from each other.

19. Plan according to claim 8, comprising upstream of the pre-finishing and finishing units a roughing stand for roughing the cast product coming from a casting machine and a preheating furnace or maintenance tunnel for maintaining the temperature of the east product.

20. The plant of claim 8, wherein the diameters of the respective back-up rolls and work rolls satisfy the following formula:

$$d_{BUR,t}^4+d_{WR,t}^4=d_{BUR,b}^4+d_{WR,b}^4,$$

where $d_{BUR,t}$=diameter of the second back-up roll, $d_{WR,t}$=diameter of the second work roll, $d_{BUR,b}$=diameter of the first back-up roll, $d_{WR,b}$=diameter of the first work roll.

* * * * *